US007418230B2

(12) United States Patent
Zess et al.

(10) Patent No.: US 7,418,230 B2
(45) Date of Patent: Aug. 26, 2008

(54) PRESSURE ROLL FOR FUSING OPERATION

(75) Inventors: Martin F. Zess, Churchville, NY (US); Alan R. Kuntz, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 368 days.

(21) Appl. No.: 11/269,334

(22) Filed: Nov. 7, 2005

(65) Prior Publication Data

US 2007/0104521 A1 May 10, 2007

(51) Int. Cl.
*G03G 15/20* (2006.01)

(52) U.S. Cl. ..... 399/331; 399/333

(58) Field of Classification Search ..... 399/328, 399/331, 333; 219/216; 492/38, 56, 59
See application file for complete search history.

(56) References Cited

U.S. PATENT DOCUMENTS 5,070,231 A * 12/1991 Bacus et al. ..... 219/216
5,967,450 A * 10/1999 May et al. ..... 242/547
6,144,832 A * 11/2000 Nimura et al. ..... 399/328
7,218,884 B2 * 5/2007 Miyazaki ..... 399/328

FOREIGN PATENT DOCUMENTS

JP 07219374 A * 8/1995
JP 08179646 A * 7/1996
JP 09251252 A * 9/1997
JP 10268601 A * 10/1998
JP 11024479 A * 1/1999

* cited by examiner

*Primary Examiner*—Robert Beatty
(74) *Attorney, Agent, or Firm*—James J. Ralabate

(57) ABSTRACT

A pressure roll used in a fusing step of an electrophotographic system is provided with a higher abrasion material at the ends of the roll. This higher abrasion material extends the useful life of the roll and reduces debris caused by deterioration of the pressure roll.

4 Claims, 2 Drawing Sheets

PRESSURE ROLL FOR FUSING OPERATION

This invention relates to an electrophotographic system, and more specifically, to a pressure roll or roller used in the toner fusing step.

BACKGROUND

Generally, in a commercial electrostatographic reproduction apparatus (such as copier/duplicators, printers, or the like), a latent image charge pattern is formed on a uniformly charged photoconductive or dielectric member. Pigmented marking particles (toner) are attracted to the latent image charge pattern to develop such image on the dielectric member. A receiver member, such as paper, is then brought into contact with the dielectric member and an electric field applied to transfer the marking particle developed image to the receiver member from the dielectric member. After transfer, the receiver member bearing the transferred image is transported away from the dielectric member and the image is fixed or fused to the receiver member by heat and/or pressure to form a permanent reproduction thereon. In a typical fusing process where the toner is fused to the paper or receiving member, two rolls are used through which the paper travels during the toner fusing. One roll, usually the harder roll, is a fuser roll, the second roll is the pressure roll or the softer roll.

Typical pressure rolls ("Softer Roll") that are used in a fusing system have an elastomeric coating like silicone which may or may not have a thin layer of another material over the surface of the roll. A functional nip is formed when the softer roll is pressed into the fuser roll ("Harder Roll"). If the softer roll is shorter than the harder roll, a support plate at the end of the roll is needed to help contain the pressure roll elastomer (silicone) material as it is pushed out during the transition through the nip. The action of the elastomer rubbing on the support plate causes the elastomer to wear and create debris in the system and excessive wear on the roll.

The pressure rolls or softer rolls are typically constructed of a cylindrical steel core or rod having positioned over it an elastomer material cylindrical roll. At the ends of the elastomer roll, generally, are positioned endplates or steel washers. In any system when a hard roll is pressed against and contacts a softer roll, high pressure zones are formed at the ends of the softer roll. These pressure zones ultimately cause the softer material to contact the support plates and create wear, shortening roll life and causing debris in the system. Also, once excessive wear takes place, improper fusing of the toner can result causing imperfect copies on the paper or receiving member. In addition, because of this wear problem, frequent changes requiring new softer rolls are required. Generally, the elastomeric rolls have typically been manufactured from a single elastomeric material such as silicon rubber, of a uniform hardness as determined by a durometer. From both a cost standpoint and performance standpoint, any improvement in the softer roll construction that would extend roll life and improve performance at the fuser station would be very desirable. Thus, eliminating material deterioration of the pressure roll would extend pressure roll life and improve fusing performance.

SUMMARY

In an embodiment, solutions to the above problems and others are accomplished by minimizing friction force between the end of the pressure roll and the metal washers by creating a transition zone of a higher abrasion-resistant material which is between them. At the ends of the elastomer roll at transition areas where pressure is the greatest during the fusing operation would be located a material or materials of greater abrasion resistance and durability than the elastomeric material of the main portion of the roll. This change would add a layer of a different elastomer to the ends of the roll to provide greater abrasion-resistant material against the support plate or steel washers. This embodiment would minimize friction force between the end of the pressure roll and metal washer by creating a transition zone of higher abrasion material between them. Typical higher abrasion materials included in this embodiment are Viton® (which is a trademark of duPont Corporation). Viton is a synthetic rubber composition derived from vinylidene fluoride and hexafluoropropylene and industry standards EPDM (ethylene propylene diene monomer rubber) and BUNA, which is a rubber substitute prepared by the polymerization of butadiene. Obviously, any suitable higher abrasion-resistant material may be used. Also, this embodiment could be used or extended to other roll designs beyond the fuser subsystem that undergo high levels of mechanical stresses. Therefore, eliminating elastomer material deterioration of the pressure roll would extend silicone pressure roll life up to two (2) times its present useful life.

The embodiments described herein involve a flexible pressure roll for use in an electrophotographic system. This roll comprises in operative relationship: a cylindrical core component and a main portion elastomeric roll encircling at least a major part of said core component. The roll has endplates positioned as washers at each end portion of the main portion elastomeric roll. Adjacent to and abutting the inner surface of each of the washers is a transitional area of a different elastomer having a greater abrasion resistance against wear than the main portion elastomeric roll.

As noted, this pressure roll has a main portion elastomeric roll made from a lower abrasion resistance material than the transitional area and is adapted to form a nip when pressed into a harder surface such as a fuser roll. The main portion elastomeric roll is enabled to transport, together with a fuser roll, a receiving member or paper containing an initially unfused toner image in a toner-fusing step.

The main portion elastomeric roll is made from a single elastomeric material of a uniform hardness as measured by a Durometer. The transitional area is positioned between each inner end portion of said main portion elastomeric roll and inner end portions of the washers.

The pressure roll when in a fusing station is positioned to move against a fuser roll during an image fusing step.

As earlier indicated, the transitional area comprises a material selected from the group consisting of Viton®, EPDM, BUNA and mixtures thereof. Any suitable high abrasion material may be used that is higher than the main portion elastrometric roll. The fuser roll and a pressure roll are used in an electrophotographic process wherein the fuser roll has a harder surface and is longer than the pressure roll. The pressure roll comprises in combination a main portion elastomeric roll and a transitional area. The transitional area is positioned between the end washers and the main portion. Also, the transitional area is positioned at each end of the main portion elastomeric roll and is constructed of a material having a greater abrasion resistance when in contact with the end washers and the harder fuser roll. All of the main portion elastomeric roll, washers and transitional area encircle a pressure roll core component or rod.

The fuser roll and the pressure roll are enabled to move a toned image-receiving member or paper through a toner-fusing station. In this roller system, the fuser roll is longer than the pressure roll. In the roller system, the pressure roll comprises a silicone material which may be coated with a Teflon® (registered trademark of Dupont Corporation) layer. Thus, the roller system has a main portion elastomeric roll comprised of a silicone material and the transitional area comprised of Viton® and both main portion elastomeric roll and transitional area are overcoated with a material such as Teflon®.

Elastomeric materials useful for the main portion elastomeric roll are silicon rubber and any other suitable materials. Any elastomer occurring naturally as natural rubber or produced synthetically as butyl rubber or neoprene may be used. However, any other suitable materials may be used for the main portion elastomeric roll.

As earlier noted, harder materials such as Viton®, and industry standards such as EPDM and BUNA can be used as the transitional area materials.

DETAILED DISCUSSION OF DRAWINGS AND PREFERRED EMBODIMENTS

Figure 1:
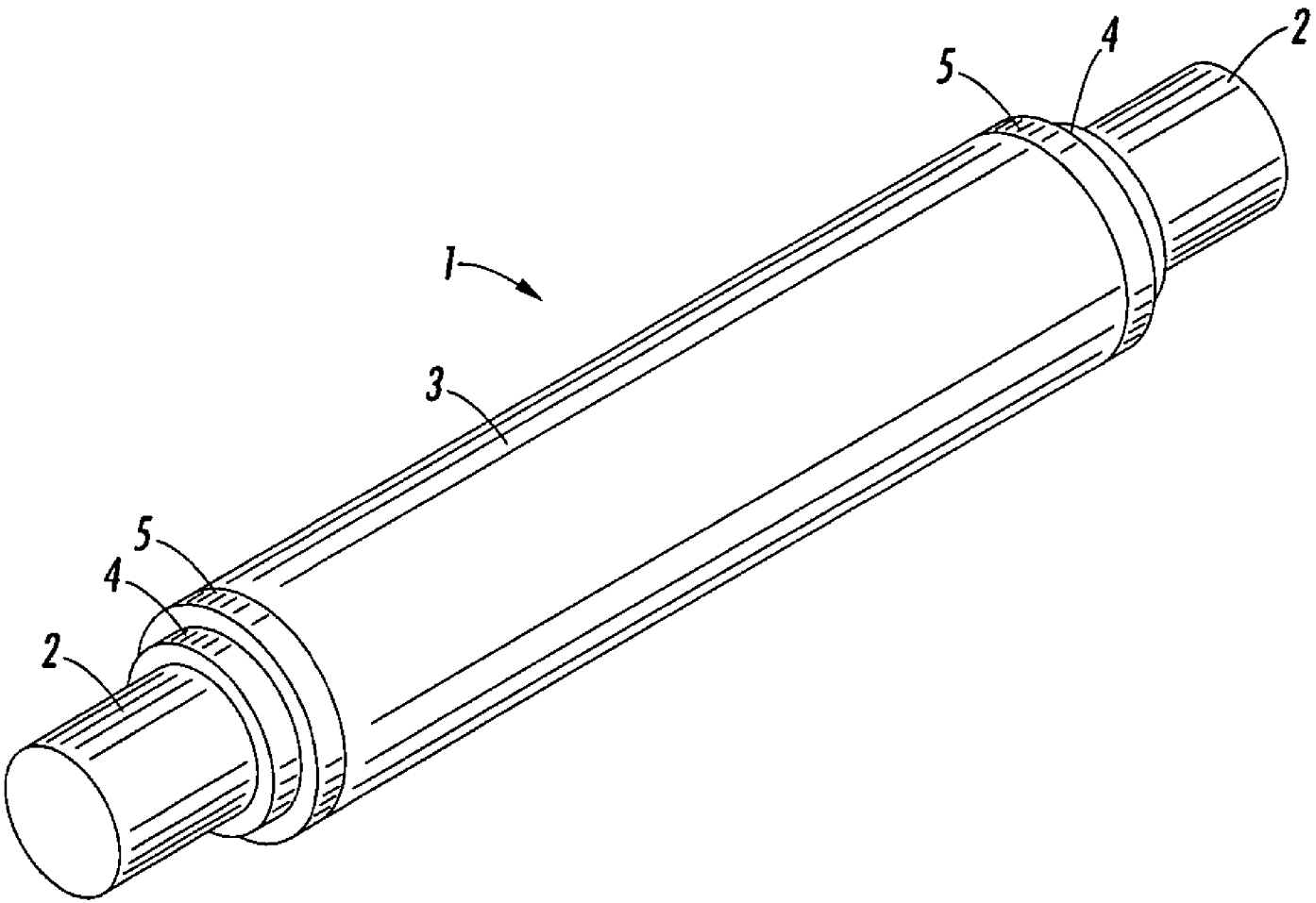
FIG. 1 illustrates an embodiment of the pressure roll described herein.

In FIG. 1, the pressure roll 1 comprises a cylindrical core component 2 that is covered by a cylindrical main portion elastomeric roll 3, endplates 4 (or washers 4) and a transitional area 5. The main portion elastomeric roll (main portion roll) 3 is made from a lower abrasion resistance material than the transitional area 5. In use, the pressure roll 1 wears most often at its end portions, therefore, a transitional area 5 which has a higher abrasion resistance than the main portion roll 3. Materials that have been found to have the physical properties required by an embodiment of this invention are Viton®, and industry standards EPDM and BUNA. Obviously, any suitable high abrasion-resistant material may be used in the transitional area 5. The transitional area 5 is positioned between the ends of the main roll portion 3 and the washers 4. The main portion roll 3 is typically made from a single elastomeric material of a uniform hardness as measured by a Durometer.

Figure 2:
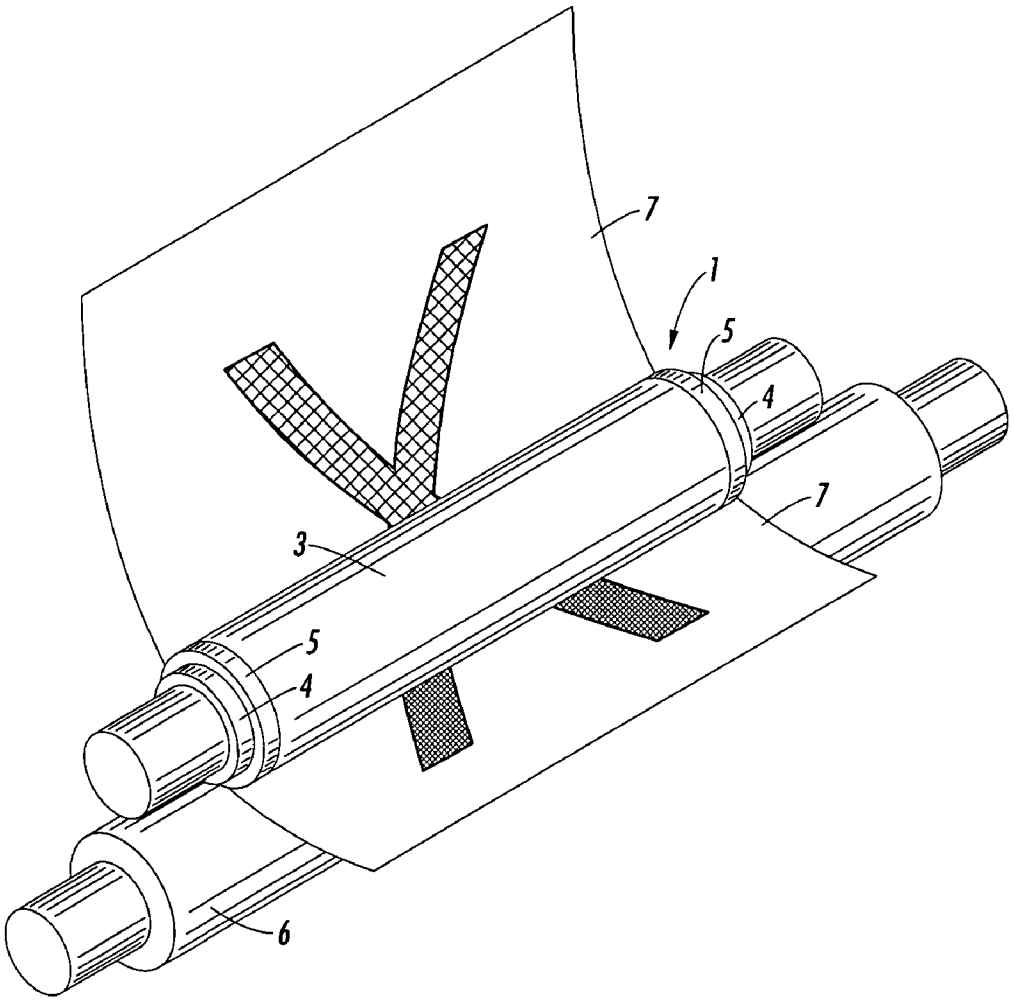
FIG. 2 illustrates the fuser roller system comprising a fuser roll and a pressure roll.

All of the main portion roll 3, washers 4 and transitional area 5 encircle a cylindrical core or rod 2. The use of transitional area 5 extends the useful life of pressure roll 1 at least two times its normal life without area 5. The toned paper 7 is fed between pressure roll 1 and fuser roll 6 as illustrated in FIG. 2. Fuser roll 6 has a harder surface than the surface of pressure roll 1, therefore, pressure roll 1 will wear especially at its end portions. Once wear occurs, the action of the elastomer of main roll 3 rubbing on the support plate (washers) 4 causes the elastomer to wear and create debris in the system. A functional nip is formed when the softer roll 1 is pressed into the fuser roll 6. If the softer roll 1 is shorter than the harder roll 6, a support plate or plates 4 at the end of the roll 1 is needed to help contain the paper 7 as it is pushed out during the transition through the nip. However, this action creates debris and, if left unattended, could shut down the electrophotographic printer or copier. This present roll embodiment with transitional area 5 not only extends the life of roll 1 but presents frequent cleaning of debris caused in the prior art systems.

The preferred and optimally preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A roller system for use in an electrophotographic method comprising in operative relationship, a fuser roll and a pressure roll, said fuser roll having a harder surface than the surface of said pressure roll, said pressure roll comprising in combination a main portion elastomeric roll and washers and a transitional area positioned between said end washers and said main portion, said transitional area positioned at each end of said main portion elastomeric roll and constructed of a different material than said main portion and made of a material having a greater abrasion resistance when in contact with said harder fuser roll, all of said main portion elastomeric roll, said washers and said transitional area encircling said pressure roll core component, said transitional area comprising a member selected from the group consisting of:

a. a synthetic rubber composition derived from vinylidene fluoride and hexafluoropropylene;

b. EPDM (ethylene propylene diene monomer rubber)

c. BUNA—a rubber substitute prepared by the polymerization of butadiene, and d. mixtures thereof, and wherein said main portion elastomeric roll comprises a silicone material and wherein said transitional area comprises a different and harder material than said main portion and wherein both said main portion elastomeric roll and said transitional area are overcoated with polyetrafluoroethylene.

2. The roller system of claim 1 wherein said main portion elastomeric roll is enabled to transport together with said fuser roll a receiving member containing an unfused toner image in a toner fusing step.

3. The roller system of claim 1 wherein said pressure roll is shorter than said fuser roll.

4. The roller system of claim 1 wherein said main portion elastomeric roll is made from a single elastomeric material having a uniform durometer.

* * * * *